US005115282A

United States Patent [19]

Higashio

[11] Patent Number: 5,115,282

[45] Date of Patent: May 19, 1992

[54] COPYING APPARATUS CAPABLE OF COPYING IN TWO COLORS SIMULTANEOUSLY

[75] Inventor: Kimihiko Higashio, Osaka, Japan

[73] Assignee: Minolta Camera Kabushiki Kaisha, Osaka, Japan

[21] Appl. No.: 639,387

[22] Filed: Jan. 11, 1991

Related U.S. Application Data

[63] Continuation of Ser. No. 268,465, Nov. 8, 1988, abandoned.

[30] Foreign Application Priority Data

Nov. 9, 1987 [JP] Japan ..... 62-282779

[51] Int. Cl.[5] ..... G03G 15/01

[52] U.S. Cl. ..... 355/328; 355/245; 355/326

[58] Field of Search ..... 355/326, 327, 328, 245, 355/233; 118/645

[56] References Cited

U.S. PATENT DOCUMENTS

| | | | |
|---|---|---|---|
| 2,910,963 | 11/1959 | Herman . | |
| 3,572,288 | 8/1968 | Turner . | |
| 3,914,043 | 10/1975 | McVeigh | 355/326 |
| 3,960,445 | 6/1976 | Drawe | 355/326 |
| 3,967,891 | 7/1976 | Rippstein . | |
| 4,099,860 | 7/1978 | Connin . | |
| 4,256,400 | 3/1981 | Komori et al. . | |
| 4,346,982 | 8/1982 | Nakajima et al. . | |
| 4,373,798 | 2/1983 | Tsukada et al. . | |
| 4,572,102 | 2/1986 | Yuge et al. . | |
| 4,579,443 | 4/1986 | Abuyama et al. | 355/314 |
| 4,582,417 | 4/1986 | Yagasaki et al. . | |
| 4,587,568 | 5/1986 | Takayama et al. . | |
| 4,619,514 | 10/1986 | Ide . | |
| 4,627,707 | 12/1986 | Tani et al. . | |
| 4,634,259 | 1/1987 | Oishi et al. . | |
| 4,641,602 | 2/1987 | Kasai . | |
| 4,655,580 | 4/1987 | Watanabe et al. . | |
| 4,657,376 | 4/1987 | Ide | 355/309 |
| 4,659,211 | 4/1987 | Oka . | |
| 4,666,288 | 5/1987 | Watanabe . | |
| 4,668,978 | 5/1987 | Gokita . | |
| 4,685,794 | 8/1987 | Watanabe . | |
| 4,690,543 | 9/1987 | Watanabe . | |
| 4,710,016 | 12/1987 | Watanabe . | |
| 4,720,730 | 1/1988 | Ito | 355/208 |
| 4,723,148 | 2/1988 | Hamakawa . | |
| 4,728,985 | 3/1988 | Nakashima et al. . | |
| 4,731,637 | 3/1988 | Acquaviva et al. . | |
| 4,740,811 | 4/1988 | Watanabe . | |
| 4,743,945 | 5/1988 | Ito et al. . | |
| 4,743,946 | 5/1988 | Nishimori et al. . | |
| 4,745,437 | 5/1988 | Oka et al. . | |
| 4,746,954 | 5/1988 | Matuura et al. . | |
| 4,754,301 | 6/1988 | Kasamura et al. . | |
| 4,772,921 | 9/1988 | Ito et al. . | |

FOREIGN PATENT DOCUMENTS

| | | |
|---|---|---|
| 3705511 | 9/1987 | Fed. Rep. of Germany . |
| 0022212 | 7/1973 | Japan . |
| 0134635 | 11/1976 | Japan . |
| 0030833 | 3/1979 | Japan . |
| 0170868 | 9/1985 | Japan . |
| 0212778 | 10/1985 | Japan . |
| 0072270 | 4/1986 | Japan . |
| 61-203474 | 9/1986 | Japan . |
| 0061464 | 3/1987 | Japan . |
| 0090186 | 6/1987 | Japan . |
| 0059504 | 12/1987 | Japan . |

*Primary Examiner*—R. L. Moses
*Assistant Examiner*—Robert Beatty
*Attorney, Agent, or Firm*—Burns, Doane, Swecker & Mathis

[57] ABSTRACT

An electrophotographic copying apparatus including an image forming device for scanning an image of an original document so as to form an electrostatic latent image of the image of the original document on a photosensitive member, three or more developing devices for developing the latent image, a selecting device for selecting two of the developing devices, a region designating device for designating, for the two selected developing devices, regions of the latent image to be developed, respectively and a device for sequentially actuating, on the basis of the designated regions, the two selected developing devices during one scanning operation of the image forming device so as to form a two-color image.

9 Claims, 16 Drawing Sheets

COPYING APPARATUS CAPABLE OF COPYING IN TWO COLORS SIMULTANEOUSLY

This application is a continuation of application Ser. No. 07/268,465, filed Nov. 8, 1988 now abandoned.

BACKGROUND OF THE INVENTION

The present invention relates to a copying apparatus capable of copying in two colors simultaneously by arbitrarily selecting two developing devices from among three or more developing devices.

The assignee assigned by the present inventor has already developed and proposed a copying apparatus capable of copying in two colors simultaneously by one copying operation, which includes a region designating means for designating, by dividing in a scanning direction of a scanning system a support face for placing an original document thereon into a plurality of copying regions, the copying regions and two developing devices are selectively changed over for drive thereof at a changeover position located at a boundary of the copying regions designated by the region designating means. However, the copying apparatus is provided with only two developing devices. Hence, in the case of copying in two colors simultaneously, the developing devices to be driven are fixed and thus, cannot be operated selectively.

In order to satisfy diversified needs for color copying in response to recent development of color copying technology, a copying apparatus has been developed which is provided with three or more developing devices containing developers of different colors, respectively. Thus, in this copying apparatus, in the case where copying in two colors simultaneously is performed by selecting two of the developing devices, the number of combination of the two selected developing devices is expressed by ${}_{N}C_{2}$ in which character N denotes an integer not less than 3 and character C denotes a mathematical symbol of combination. Therefore, two developing devices can be arbitrarily selected from among the provided developing devices and are required to be selected.

SUMMARY OF THE INVENTION

Accordingly, an essential object of the present invention is to provide, in view of the foregoing, a copying apparatus provided with three or more developing devices, which is capable of copying in two colors simultaneously by arbitrarily selecting two developing devices from among the developing devices.

In order to accomplish this object of the present invention, a copying apparatus embodying the present invention comprises: three or more developing devices containing developers of different colors, respectively; a region designating means which divides in a scanning direction of a scanning system a support face for placing an original document thereon into a plurality of copying regions so as to designate the copying regions; a control means which selectively changes over two of said developing devices for drive thereof at changeover positions located at boundaries of the copying regions designated by said region designating means such that copying in two colors simultaneously is performed by one copying operation; a mode setting means for setting said copying apparatus to a mode for copying in two colors simultaneously; and a selection means which, when said copying apparatus is set to the mode by said mode setting means, arbitrarily selects from among said developing devices two developing devices to be driven in the mode for copying in two colors simultaneously.

In the copying apparatus of the present invention, when the copying apparatus is set to the mode for copying in two colors simultaneously, a combination of two developing devices is selected from among the three or more developing devices by the selection means and the two developing devices are sequentially changed over for drive thereof at the copying regions designated by the region designating means such that copying in two colors simultaneously is performed.

BRIEF DESCRIPTION OF THE DRAWINGS

This object and features of the present invention will become apparent from the following description taken in conjunction with the preferred embodiment thereof with reference to the accompanying drawings, in which.

Before the description of the present invention proceeds, it is to be noted that like parts are designated by like reference numerals throughout several views of the accompanying drawings.

DETAILED DESCRIPTION OF THE INVENTION

Figure 1:
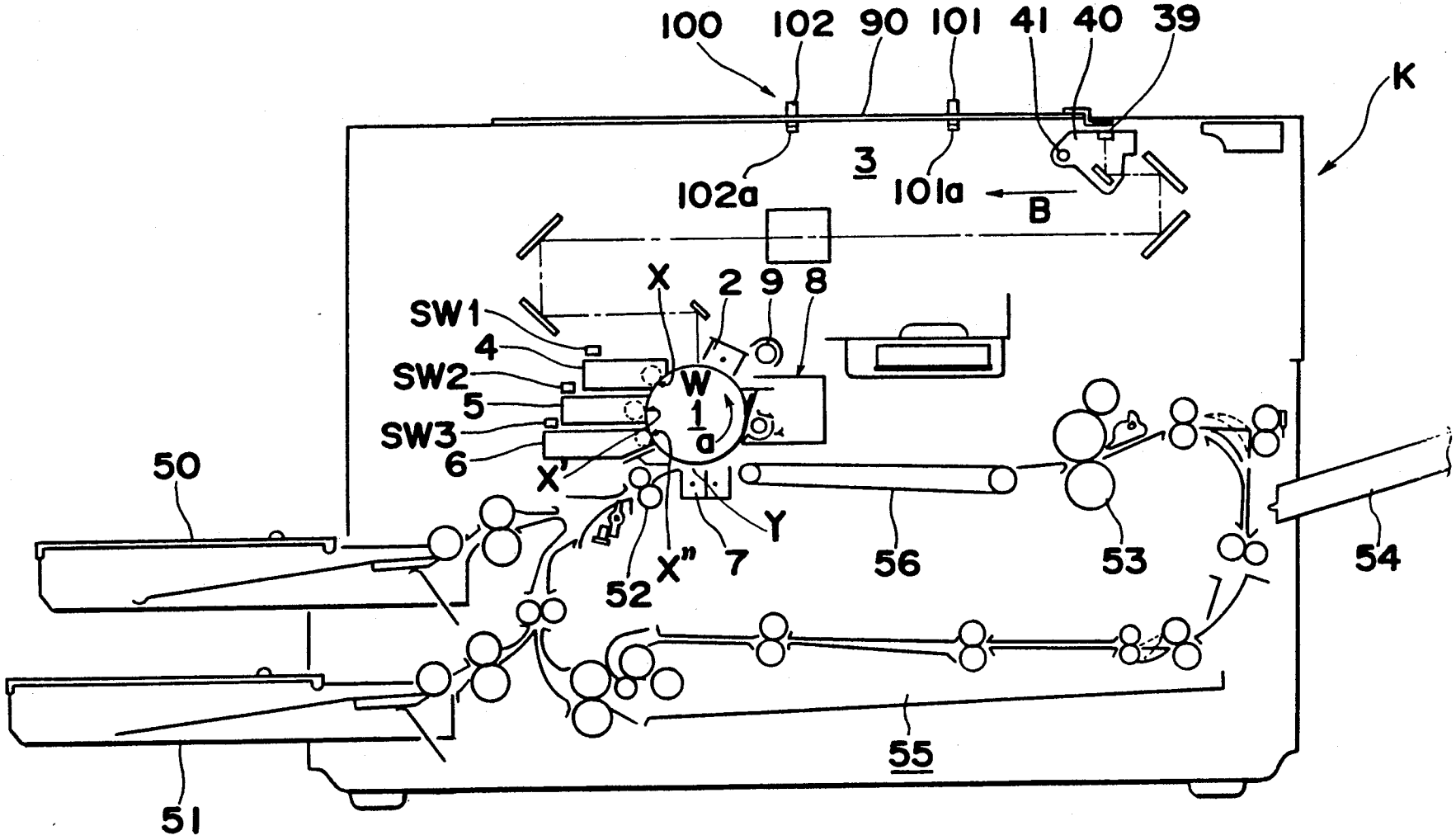
FIG. 1 is a schematic sectional view of a copying apparatus capable of copying in two colors simultaneously, according to one embodiment of the present invention.

Referring now to the drawings, there is shown in FIG. 1, a copying apparatus K which is capable of copying in two colors simultaneously by a single copying operation, according to one embodiment of the present invention. A schematic structure and a standard copying operation of the copying apparatus K are described, hereinbelow. Initially, in a state where a photosensitive drum 1 is rotated in the direction of the arrow a, a predetermined amount of electric charge is imparted to the surface of the photosensitive drum 1 by electric discharge of a corona charger 2. Then, a scanner 40 of an optical system 3, which includes an exposure lamp 41, irradiates light onto an original document placed on an original platform 90 made of glass while being displaced for scanning in the direction of the arrow B. The scanner 40 is provided with a slot 39 for a read switch 110 (discussed below). Reflected light from the original document is exposed onto the surface of the photosensitive drum 1 at an exposure point W through mirrors and a lens such that an electrostatic latent image corresponding to an image of the original document is formed.

Subsequently, at developing regions X, X' and X'', which are portions of the photosensitive drum 1 confronting first, second and third developing devices 4, 5 and 6, respectively, the electrostatic latent image is supplied with toners so as, to be developed into a visible toner image which reproduces the image of the original document. Meanwhile, a copy paper sheet is supplied selectively from a paper feeding portion 50 or 51 and is transported, synchronously with the toner image on the photosensitive drum 1 by timing rollers 52, to a portion (a transfer region Y) of the photosensitive drum 1 confronting a transfer charger 7. After the toner image has been transferred onto the copy paper sheet at the transfer region Y, the copy paper sheet is conveyed by a transport belt 56 in between a pair of fixing rollers 53 at which the toner image is fixed through fusion thereof onto the copy paper sheet. Thereafter, the copy paper sheet having the fixed toner image thereon is discharged to a copy receiving portion 54.

However, if a duplex copying mode is selected, the copy paper sheet is transported to a duplex device 55. At the duplex device 55, the copy paper sheet is turned over such that the copied face is directed upwardly. Then, the copy paper sheet is again fed to the transfer region Y, while the second copying operation is performed around the optical system 3 and the photosensitive drum 1 such that the image of the original document is formed on the reverse face of the copy paper sheet. Meanwhile, if a composite copying mode is selected, the copy paper sheet is conveyed to the duplex device 55 such that the copied face is directed downwardly. Subsequently, the copy paper sheet is fed to the transfer region Y again, while the second copying operation is performed around the optical system 3 and the photosensitive drum 1 such that the image of the original document is formed on the copied face of the copy paper sheet.

Residual toner is scraped off from the surface of the photosensitive drum 1 by a cleaning device 8. Furthermore, residual electric charge is erased from the surface of the photosensitive drum 1 through irradiation of light onto the surface of the photosensitive drum 1 by an eraser lamp 9 such that the next copying operation can be performed.

In addition to the above described standard copying operation, the copying apparatus K is capable of copying in two colors by a single scanning operation of the scanner 40. To this end, the copying apparatus K is provided with a region designating mechanism 100 and each of the first, second and third developing devices 4, 5 and 6 is provided with a special mechanism. Initially, the first, second and third developing devices 4, 5 and 6 are described. The first, second and third developing devices 4, 5 and 6 are detachably mounted on an apparatus housing and can be replaced by developing devices of the same type containing developers of different colors, respectively. In this embodiment, the second developing device 5 is a black developing device containing developer composed of black toner and carrier, while the first developing device 4 is a red developing device containing developer composed of red toner and carrier. Meanwhile, the third developing device 6 is a blue developing device containing blue toner and carrier.

The first, second and third developing devices 4, 5 and 6 can be detachably mounted on the apparatus housing at predetermined positions shown in FIG. 1, respectively. Mounting and dismounting of the first, second and third developing devices 4, 5 and 6 can be detected by switches SW1, SW2 and SW3, respectively. Although not specifically shown, magnets are, respectively, attached to upper faces of the developing devices 4, 5 and 6 and reed switches SW4 to SW12 (FIG. 11) are fixed to the apparatus housing at positions corresponding to those of the magnets such that the colors of the toners contained in the developing devices 4, 5 and 6 can be discriminated by combinations of ON and OFF of the reed switches SW4 to SW12.

Figure 4:
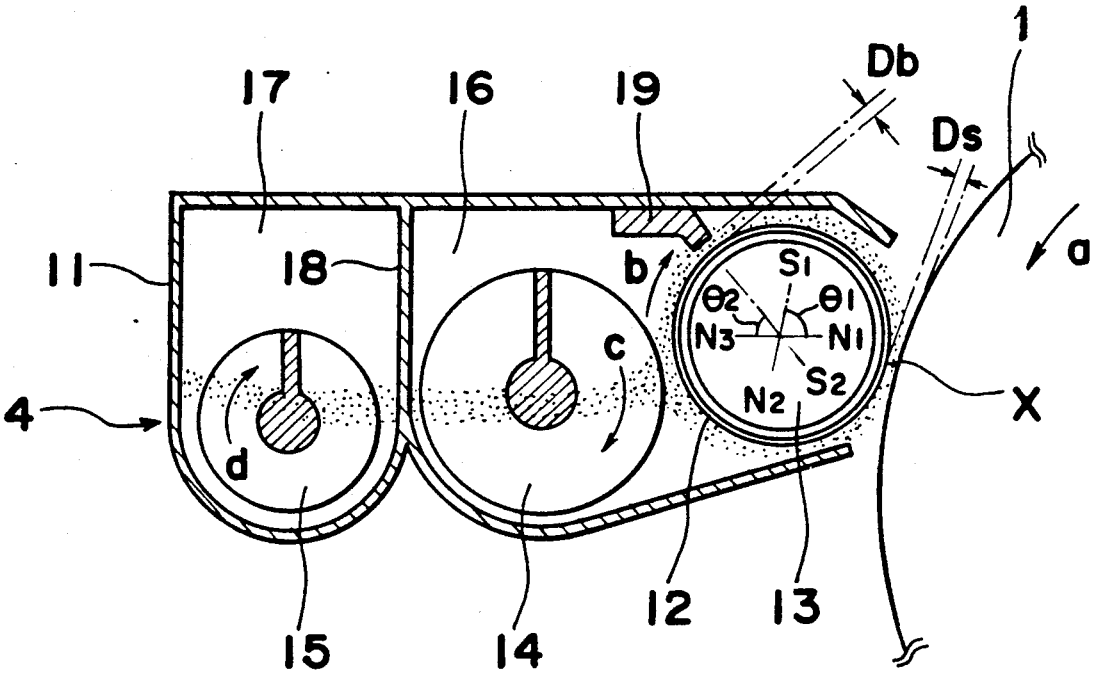
FIG. 4 is a sectional view showing a developable state of an array of magnetic poles of a magnet roller of the first developing device of FIG. 3.

Hereinbelow, construction of the developing devices 4, 5 and 6 is described. Meanwhile, since the developing devices 4, 5 and 6 have an identical construction, only the developing device 4 is described and description of the developing devices 5 and 6 is abbreviated for the sake of brevity. In a developing tank 11 of the developing device 4, a developing sleeve 12, a supply roller 14 and a screw 15 are sequentially arranged in a direction away from the photosensitive drum 1. The developing sleeve 12 is made of non-magnetic and electrically conductive material and is formed into a cylindrical shape having a diameter of 24.5 mm. Minute concave and convex portions are formed on the outer periphery of the developing sleeve 12 by sandblasting. The developing sleeve 12 confronts, at the developing region X, the photosensitive drum 1 through a developing gap Ds of 0.6 mm. A rotational angle $\alpha$ from the exposure point W to the developing region X is set at 56°. Meanwhile, at a side of the developing sleeve 12 remote from the developing region X, a bristle height regulating member 19 is provided on an inner face of an upper portion of the developing tank 11 so as to confront the developing sleeve 12 through a bristle height regulating gap Db of 0.4 mm as shown in FIG. 4.

In the developing sleeve 12, a magnet roller 13 having a plurality of axially extending magnets is provided. N-poles N1, N2 and N3 and S-poles S1 and S2 disposed at the outer peripheral surfaces of the magnets have magnetic forces of 1000 G (gauss), 500 G, 500 G, 800 G and 800 G, respectively. As shown in FIG. 4, the center of the magnetic pole N1 is displaced through an angle $\theta 1$ of 80° from the center of the magnetic pole S1 in the clockwise direction. In a state where the magnetic pole N1 confronts the photosensitive drum 1, the center of the magnetic pole N3 is displaced through an angle of θ2 of 40° from a portion of the developing sleeve 12 confronting the bristle height regulating member 19.

Figure 3:
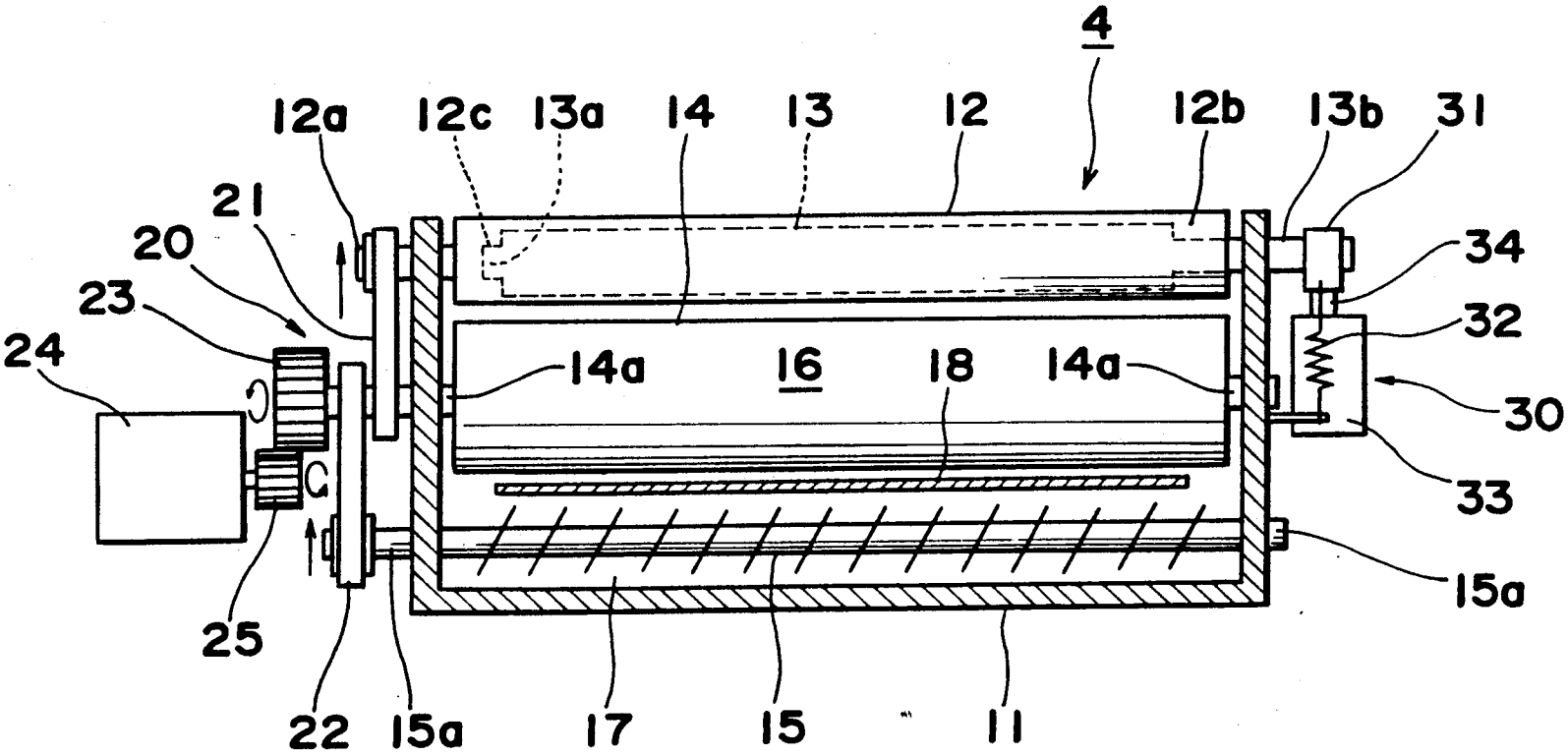
FIG. 3 is a cutaway top plan view of the first developing device of FIG. 2.

As shown in FIG. 3, the magnet roller 13 has support shafts 13*a* and 13*b* formed at opposite end portions thereof, respectively. The support shaft 13*a* is fitted into a bearing recess 12*c* formed in the developing sleeve 12, while the support shaft 13*b* is supported by one side wall of the developing tank 11. The magnet roller 13 can be rotated the predetermined angle θ2 of 40° by a displacement means 30 to be described later.

On the other hand, the developing sleeve 12 has a bearing portion 12*b* formed at its one side and a support shaft 12*a* formed at the other side. The bearing portion 12*b* is supported by the support shaft 13*b* of the magnet roller 13, while the support shaft 12*a* is supported by the other side wall of the developing tank 11 such that the developing sleeve 12 is driven for rotation thereof by a driving means 20.

The supply roller 14 and the screw 15 have support shafts 14*a* and 15*a*, respectively and are, respectively, provided in transport passages 16 and 17 which are separated from each other by a partition wall 18. The support shafts 14*a* and 15*a* are supported by the side walls of the developing tank 11 such that the supply roller 14 and the screw 15 are driven for rotation thereof by the driving means 20. As shown in FIG. 3, the transport passages 16 and 17 are communicated with each other at opposite sides of the partition wall 18.

Hereinbelow, the driving means 20 for driving the developing sleeve 12, the supply roller 14 and the screw 15 of the developing device 4 is described. Since driving means for the developing devices 5 and 6 are the same as the driving means 20 for the developing device 4, description thereof is abbreviated for the sake of brevity. As shown in FIG. 3, a belt 21 is trained over the support shaft 12*a* of the developing sleeve 12 and the support shaft 14*a* of the supply roller 14 and a belt 22 is trained over the support shaft 14*a* of the supply roller 14 and the support shaft 15*a* of the screw 15. Meanwhile, a gear 23 is mounted on an end portion of the support shaft 14*a* of the supply roller 14 so as to be held in mesh with a driving gear 25 of a motor 24. Therefore, when the driving gear 25 is rotated in the direction of the arrow of FIG. 3 by driving the motor 24, the gear 23 and the belts 21 and 22 are actuated in the directions of the arrows of FIG. 3, respectively. Hence, the developing sleeve 12, the supply roller 14 and the screw 15 are rotated in the directions of the arrows b, c and d of FIG. 2, respectively. The developing sleeve 12 is arranged to be rotated at a speed of 240 rpm.

Figure 5:
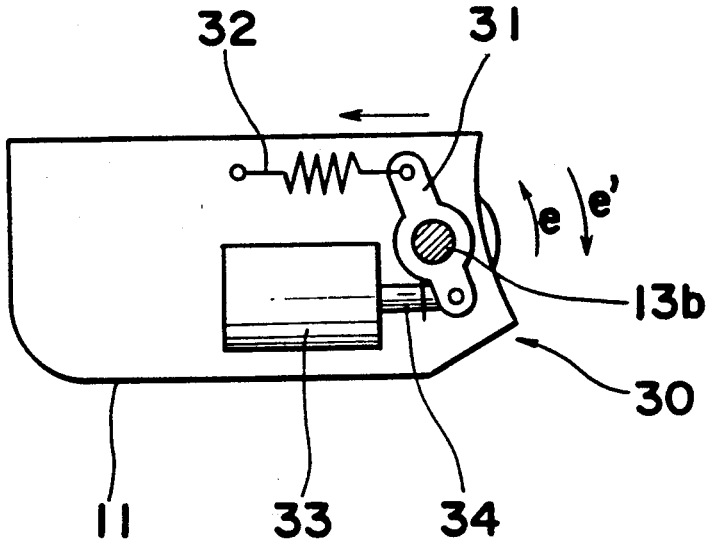
FIG. 5 is a front elevational view showing a driven state of a displacement means for the magnet roller of FIG. 4.
Figure 7:
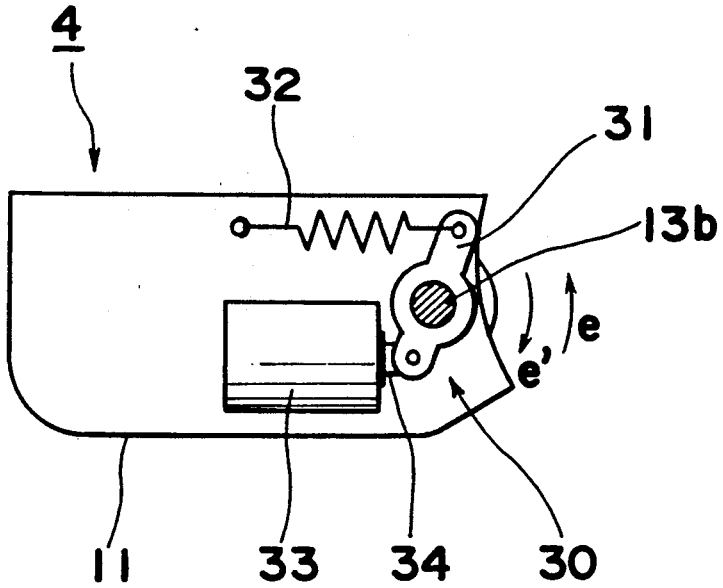
FIG. 7 is a view similar to FIG. 5, particularly showing an undriven state of the displacement means.

As shown in FIGS. 5 and 7, the displacement means 0 for the magnet roller 13 is constituted by a lever 31, a spring 32 and a solenoid 33. The lever 31 is secured to one end portion of the support shaft 13*b*. One end of the spring 32 fixed to the developing tank 11 is attached to one end portion of the lever 31 such that the lever 31 is urged in the direction of the arrow e at all times by the spring 32. Meanwhile, a plunger 34 of the solenoid 33 is attached to the other end portion of the lever 31. Upon energization of the solenoid 33, the lever 31 is rotated in the direction of the arrow e' against an urging force of the spring 32. At the time of de-energization of the solenoid 33, namely, when the lever 31 is held in a state shown in FIG. 5, the magnetic pole N1 of the magnet roller 13 confronts the photosensitive drum 1 and the magnetic pole N3 is retracted through the angle θ2 of 40° in the counterclockwise direction from the portion of the developing sleeve 12 confronting the bristle height regulating member 19 as shown in FIG. 4. In this state, developer on the developing sleeve 12 is brought into contact with the photosensitive drum 1 so as to enable development of the latent image on the photosensitive drum 1.

On the other hand, when the lever 31 is held in a state shown in FIG. 7 upon energization of the solenoid 33, the magnetic pole N3 confronts the bristle height regulating member 19 and an intermediate portion between the magnetic poles N1 and S1 confronts the photosensitive drum 1. In this state, the developer on the developing sleeve 12 is held out of contact with the photosensitive drum 1 and thus, it is impossible to develop the latent image on the photosensitive drum 1.

Figure 8:
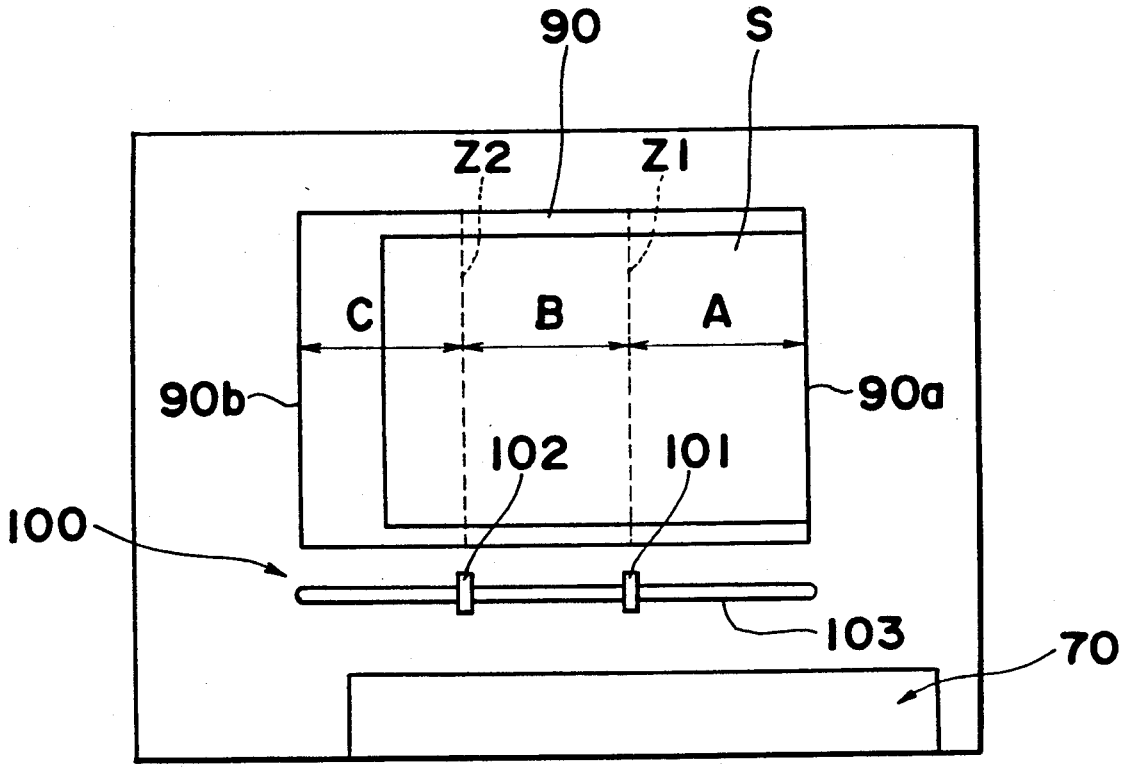
FIG. 8 is a top plan view of a region designating mechanism employed in the copying apparatus of FIG. 1.
Figure 9:
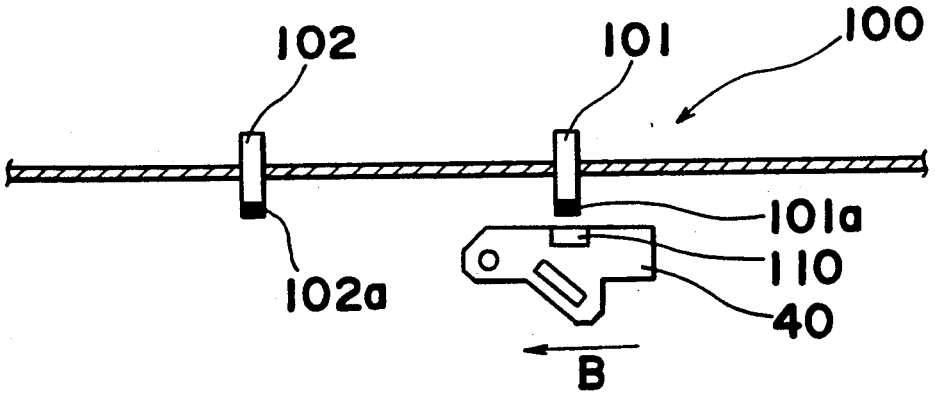
FIG. 9 is a front elevational view of the region designating mechanism of FIG. 8.

Hereinbelow, the region designating means 100 is described with reference to FIGS. 8 and 9. In the region designating means 100, a support face of the original platform 90, on which the original document is placed, is divided into regions in the scanning direction of the arrow B of the scanner 40 by first and second levers 101 and 102 such that the regions are designated. The first and second levers 101 and 102 are fitted into a guide slot 103 formed at one side of original platform 90 along the scanning direction of the scanner 40. Magnets 101*a* and 102*a* are provided at lower portions of the first and second levers 101 and 102, which are disposed in the apparatus housing. In a state where the levers 101 and 102 are set as shown in FIG. 8, a portion from a front end 90*a* of the original platform 90 to the first lever 101, a portion from the first lever 101 to the second lever 102 and a portion from the second lever 102 to a rear end 90*b* of the original platform 90 are, respectively, designated as regions A, B and C, respectively. Meanwhile, a reed switch 110 is provided at the scanner 40 of the optical system 3. The reed switch 110 detects the magnets 101*a* and 102*a* so as to output the detection signals to a control device shown in FIG. 11.

Figure 10:
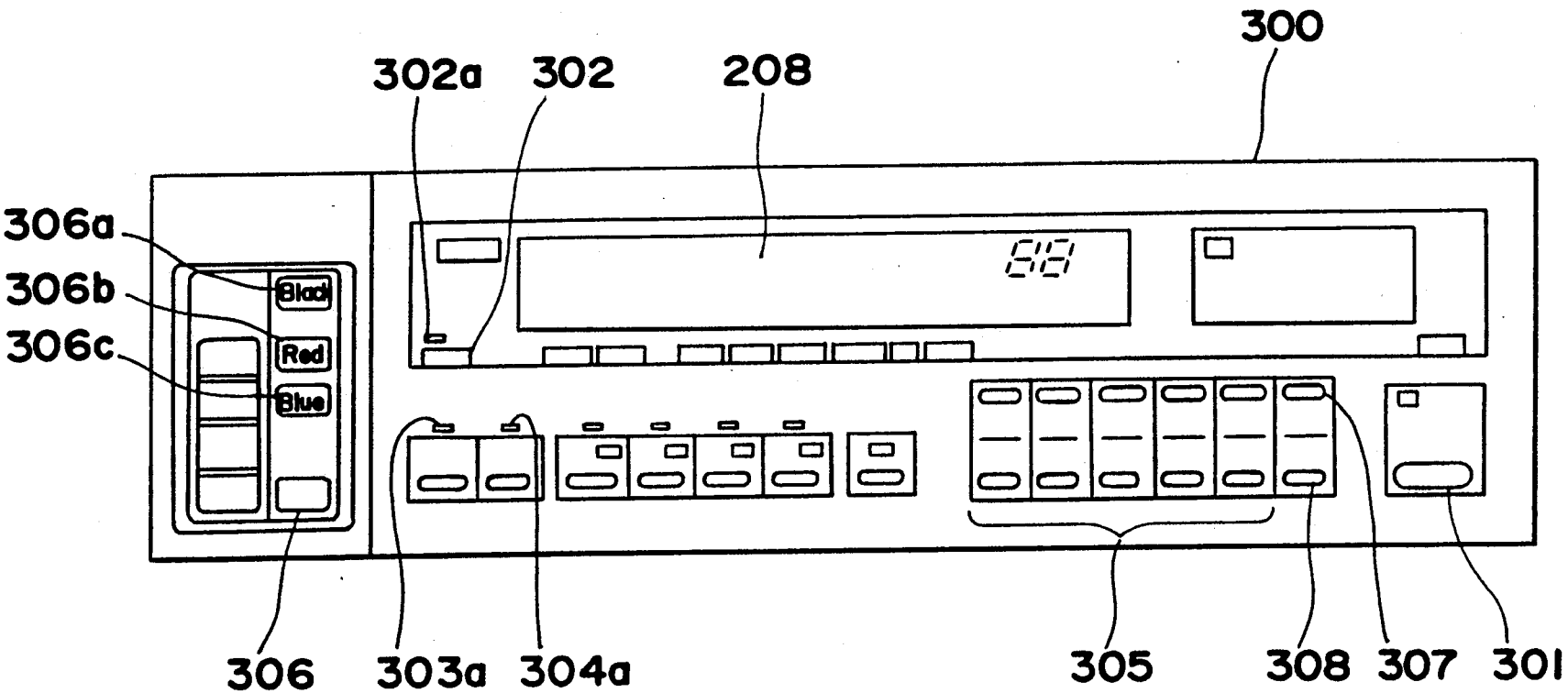
FIG. 10 is a top plan view of an operating panel of the copying apparatus of FIG. 1.

Hereinbelow, an operating panel 300 provided on the apparatus housing is described with reference to FIG. 10. The operating panel 300 includes a print key 301, a display portion 208 for displaying the number of copies to be taken, trouble codes, etc., ten keys 305, an interruption key 307, a clear/stop key 308, a selection key 302 for selecting a mode for copying in two colors simultaneously (hereinbelow, referred to as a "simultaneous color copying mode"), a display LED 302*a* for displaying the simultaneous color copying mode, a color selection key 306 and display LEDs 306*a* to 306*c* for displaying the colors of the toners of selected ones of the developing devices 4, 5 and 6.

Figure 11:
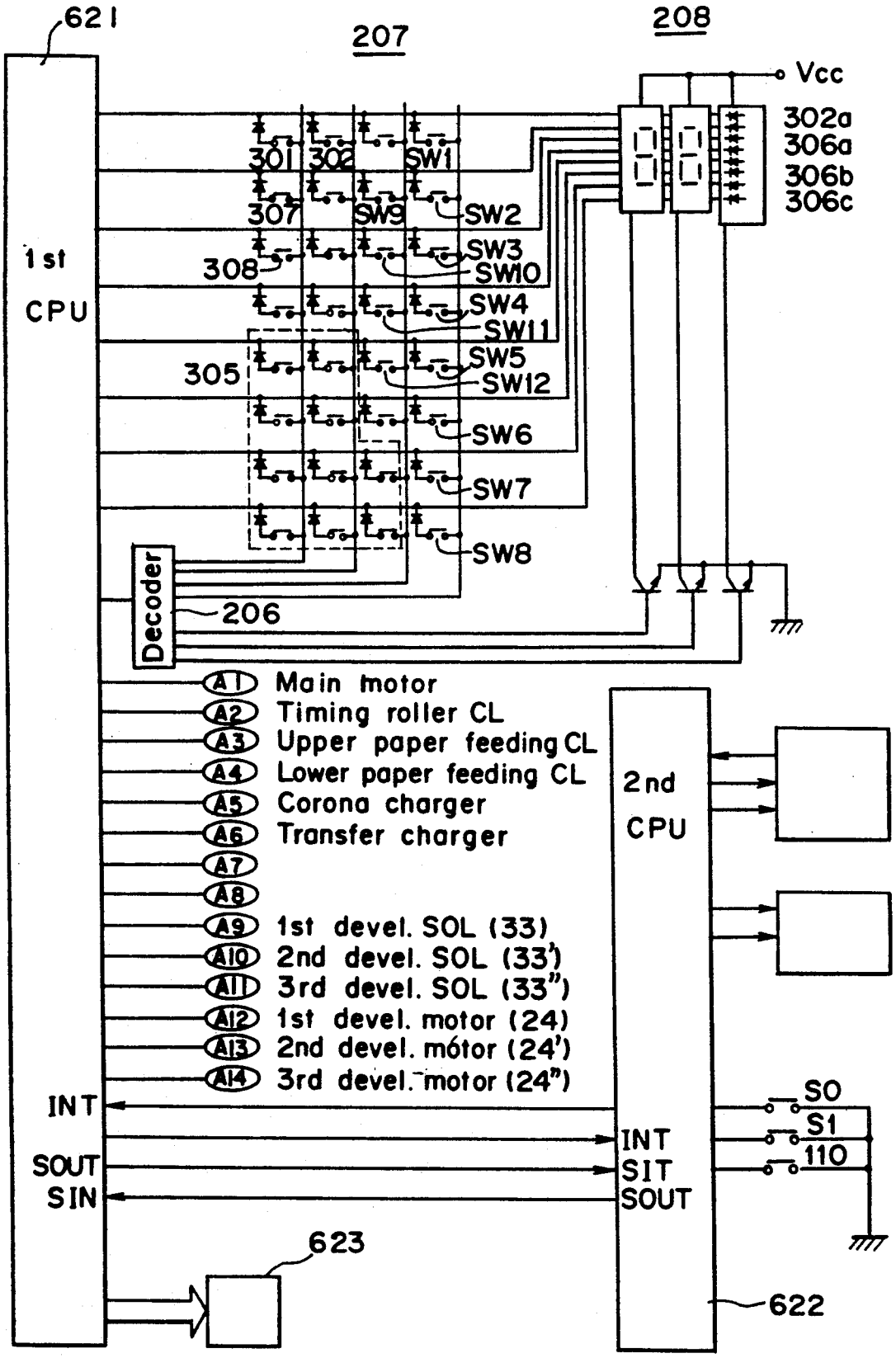
FIG. 11 is a block diagram of a control circuit of the copying apparatus of FIG. 1.

As shown in FIG. 11, the control portion of the copying apparatus K of the above described arrangement is constituted by a first central processing unit (CPU) 621 acting as a main control unit, a second CPU 622 for controlling the optical system 3 and a random access memory (RAM) 623. In order to synchronize the first and second CPUs 621 and 622 with each other, the first and second CPUs 621 and 622 are connected to each other. A switch matrix 207 in which the various keys on the operating panel 300, the switches SW1, SW2 and SW3 for detecting the developing devices 4, 5 and 6, respectively, the switches SW4 to SW12 for detecting the colors of the toners, etc. are provided in a pattern of a matrix is connected to the first CPU 621. The display portion 208, the display LED 302*a*, the display LEDs 306*a* to 306*c*, etc. are connected to the first CPU 621 through the switch matrix 207 and a decoder 206. A main motor, various clutches, the motors of the first, second and third developing devices 4, 5 and 6, etc. are connected to output terminals A1 to A14 so as to be subjected to on-off control on the basis of signals from the switch matrix 207. Meanwhile, a control portion 221 for controlling drive of a scanning motor, a control portion 202 for controlling drive of a stepping motor for driving the lens, a positioning switch SO to be turned on and off by the scanner 40, the reed switch 110 attached to the scanner 40, etc. are connected to the second CPU 622.

Figure 12:
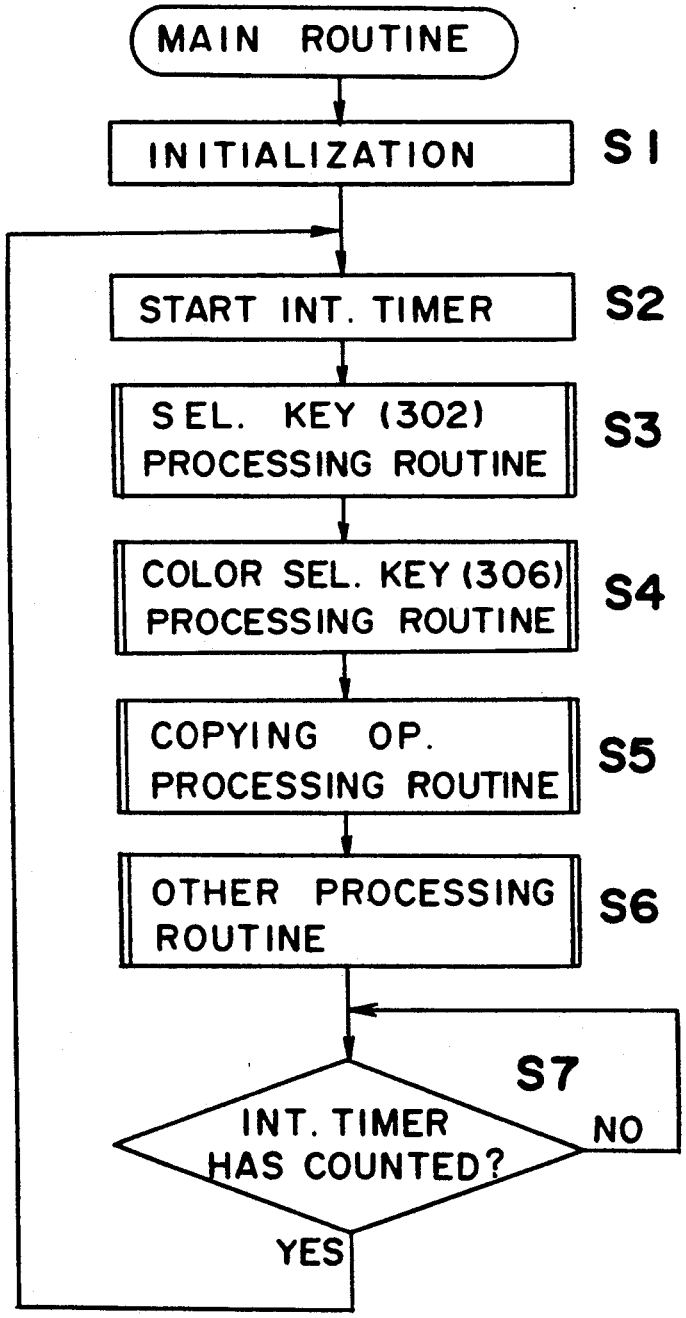
FIG. 12 is a flow chart showing a main routine of an operational sequence of the copying apparatus of FIG. 1.

Hereinbelow, control operation of the copying apparatus K is described with reference to flow charts of FIGS. 12 to 15. Before description of the flow charts of FIGS. 12 to 15 proceeds, terms "ON edge" and "OFF edge" are defined as follows. Namely, the term "ON edge" is defined as change of a state of a switch, a sensor, a signal or the like from the OFF state to the ON state. On the other hand, the term "OFF edge" is defined as change of a state of a switch, a sensor, a signal or the like from the ON state to the OFF state. FIG. 12 shows a main routine of the first CPU 621. When the program is started upon resetting of the first CPU 621, initialization such as clearing of the RAM 623, initialization of various registers and setting of the various devices to an initial mode is performed as step S1. Then, at step S2, an internal timer is started. This internal timer is provided for determining a time period required for executing the main routine. A preset value of the internal timer is set at step S1. Subsequently, at step S3, processing of the selection key 302 for selecting the simultaneous color copying mode is performed as described in detail later. Processing of the color selection key 306 is performed at step S4 and a copying operation is performed at step S5. At step S6, other processings are performed. When processings of all the subroutines have been completed, completion of counting of the preset value by the internal timer is waited for at step S7 such that the program flow returns to step S2. By using the time period of this one routine, counting of each of various timers of the respective subroutines is performed.

Figure 13:
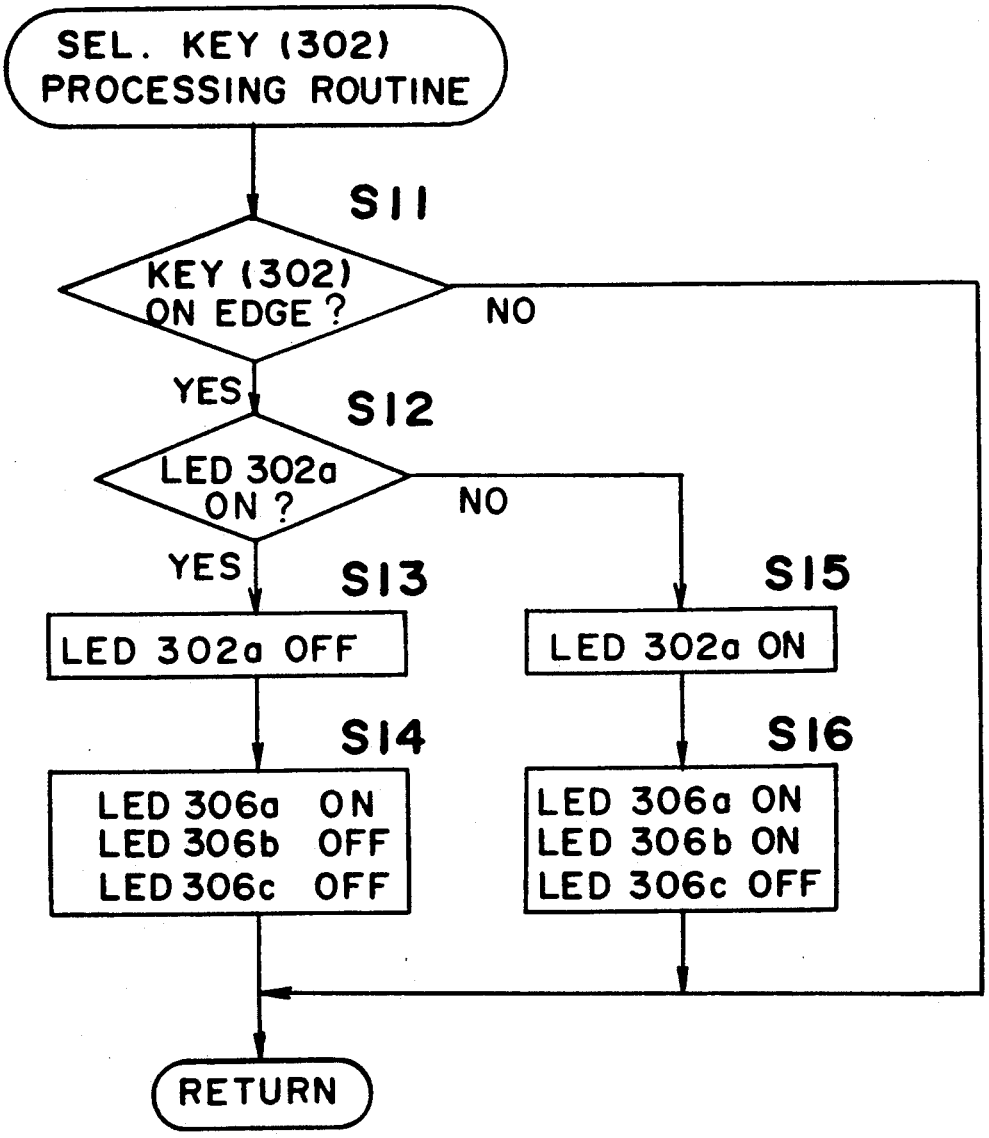
FIG. 13 is a flow chart showing a processing routine of a key for selecting a mode for copying in two colors simultaneously in the copying apparatus of FIG. 1.

FIG. 13 shows a processing routine of the selection key 302 for selecting the simultaneous color copying mode. Initially, at step S11, it is decided whether or not the selection key 302 is at the ON edge. In the case of "YES" at step S11, a decision is made at step S12 as to whether or not the display LED 302*a* for displaying the simultaneous color copying mode is in the ON state, namely, the simultaneous color copying mode was selected before the selection key 302 is depressed. In the case of "YES" at step S12, the display LED 302*a* is turned off at step S13 so as to cancel the simultaneous color copying mode. Subsequently, at step S14, the display LED 306*a* for displaying the color of the toner of the second developing device 5 is turned on and the display LED 306*b* for displaying the color of the toner of the first developing device 4 and the display LED 306*c* for displaying the color of the toner of the third developing device 6 are turned off. Meanwhile, in the case of "NO" at step S12, the display LED 302*a* is turned on so as to select the simultaneous color copying mode at step S15. Then, at step S16, the display LEDs 306*a* and 306*b* for displaying the colors of the toners of the second and first developing devices 5 and 4, respectively are turned on.

Figure 14:
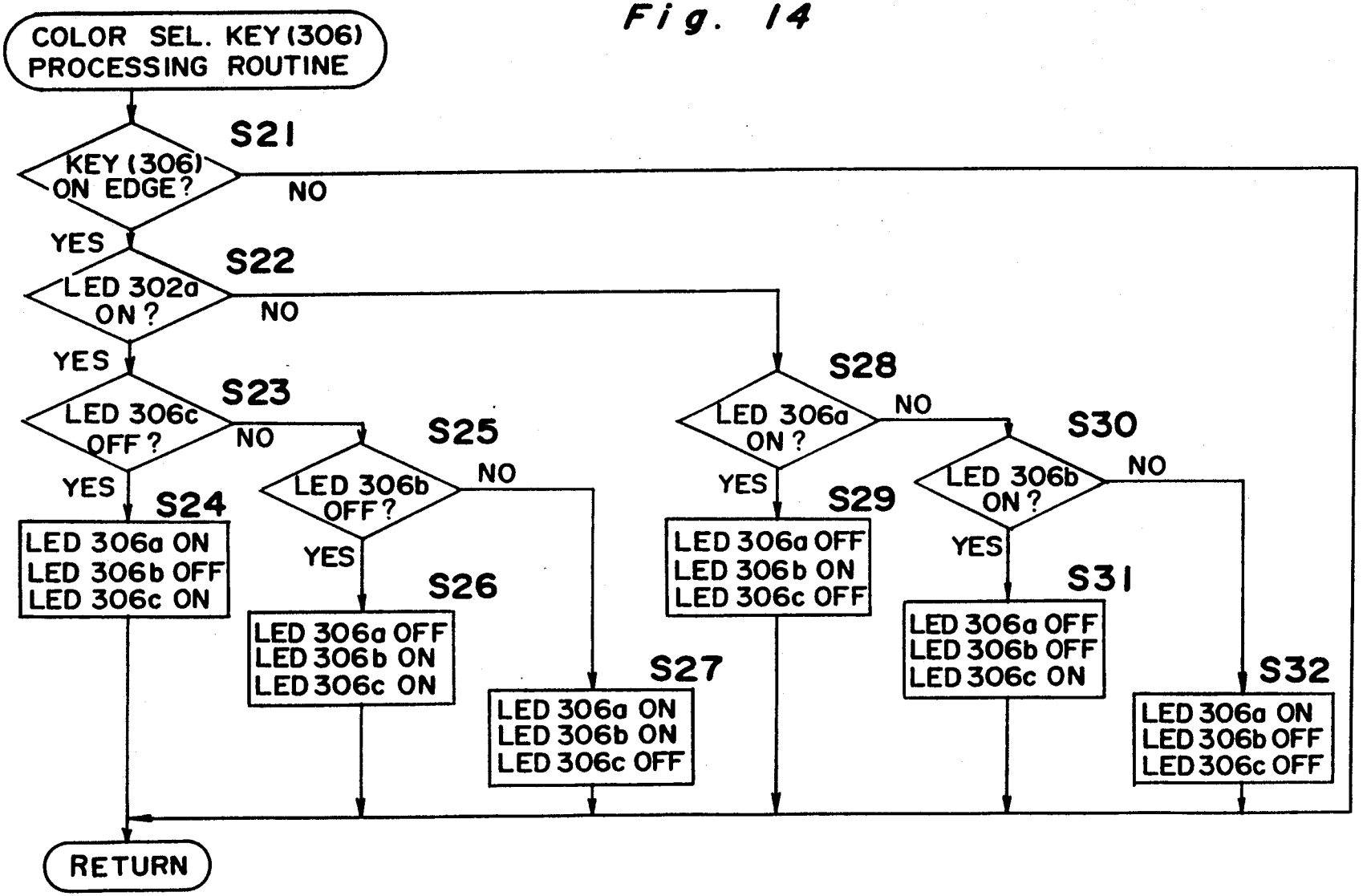
FIG. 14 is a flow chart showing a processing routine of a color selection key of the copying apparatus of FIG. 1.

FIG. 14 shows a processing routine of the color selection key. Initially, at step S21, it is decided whether or not the color selection key 306 is at the ON edge. In the case of "YES" at step S21, a decision is made at step S22 as to whether or not the display LED 302*a* for displaying the simultaneous color copying mode is in the ON state, namely, the simultaneous color copying mode is selected. In the case of "YES" at step S22, it is decided at step S23 whether or not the display LED 306*c* for displaying the color of the toner of the third developing device 6 is in the OFF state, namely, the first and second developing devices 4 and 5 are selected without selecting the third developing device 6. In the case of "YES" at step S23, the display LED 306*b* for displaying the color of the toner of the first developing device 4 is turned off and the display LEDs 306*a* and 306*c* for displaying the colors of the toners of the second and third developing device 5 and 6 are turned on at step S24 such that the second and third developing devices 5 and 6 are selected. In the case of "NO" at step S23, it is decided at step S25 whether or not the display LED 306*b* for displaying the color of the toner of the first developing device 4 is in the OFF state. In the case of "YES" at step S25, the display LEDs 306*b* and 306*c* are turned on at step S26 such that the first and third developing devices 4 and 6 are selected. Meanwhile, in the case of "NO" at step S25, the display LEDs 306*a* and 306*b* are turned on at step S27 such that the second and first developing devices 5 and 4 are selected.

Meanwhile, in the case of "NO" at step S22, based on a decision as to whether or not the display LED of a currently selected one of the developing devices is in the ON state, another developing device is sequentially selected from among the three developing devices. Namely, when the second developing device 5 has been selected, the first developing device 4 is selected at steps S28 and S29. Meanwhile, when the first developing device 4 has been selected, the third developing device 6 is selected at steps S30 and S31. Furthermore, when the third developing device 6 has been selected, the second developing device 5 is selected at steps S28, S30 and S32.

Figure 15:
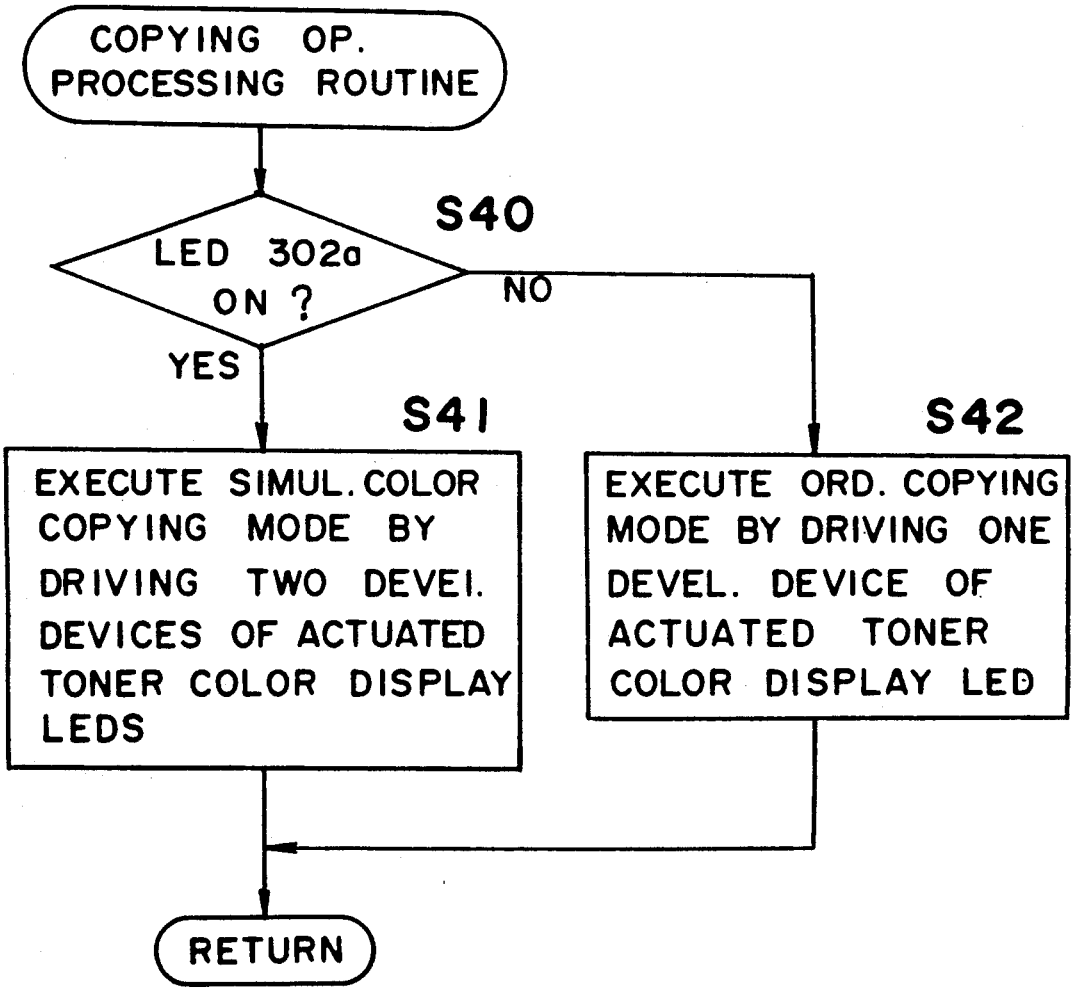
FIG. 15 is a flow chart showing a processing routine of a copying operation of the copying apparatus of FIG. 1.

FIG. 15 shows a processing routine of a copying operation of the copying apparatus K. At step S40, it is decided whether or not the display LED 302*a* for displaying the simultaneous color copying mode is in the ON state. In the case of "YES" at step S40, two developing devices whose display LEDs are in the ON state are driven such that the simultaneous color copying mode is executed at step S41. In the case of "NO" at step S40, one developing device whose display LED is in the ON state is driven such that a standard copying mode is executed at step S42.

Figure 6:
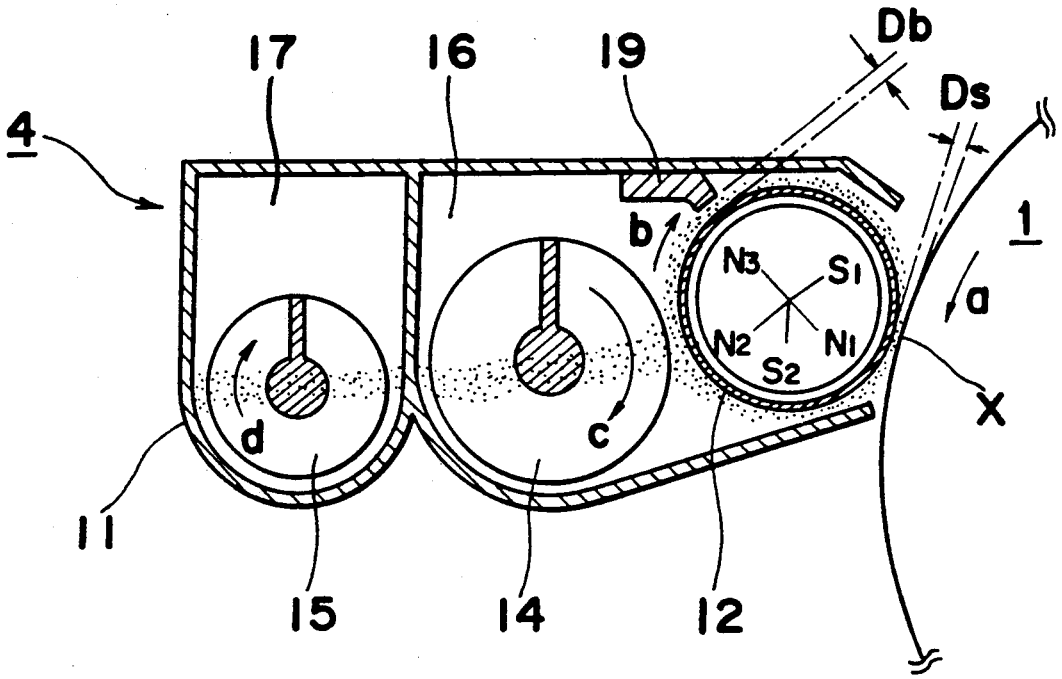
FIG. 6 is a view similar to FIG. 4, particularly showing a state of completion of development.

Then, operation of the simultaneous color copying mode shown at step S41 of FIG. 15 is described in detail with reference to timing charts of FIGS. 16*a*, 16*b*, 16*c* and 17. Initially, a case in which the first and second developing devices 4 and 5 are selected is described by using FIG. 16*a*. It is to be noted that reference numerals for components of the second developing device 5 are expressed by adding a prime (') to those of the first developing device 4. Initially, when a power source is turned on by turning on a main switch (not shown) of the copying apparatus K, the intermediate portion between the magnetic poles N1 and S1 of the first developing device 4 confronts the photosensitive drum 1 as shown in FIG. 6 and the magnetic pole N1 of the second developing device 5 confronts the photosensitive drum 1 as shown in FIG. 4. When the print key 301 is turned on in this state, the second developing device 5 containing black toner is automatically driven such that the standard copying operation is performed. Meanwhile, when the selection key 302 for selecting the simultaneous color copying mode is turned on in this state, the copying apparatus K is set to a state enabling execution of the simultaneous color copying mode as described below. However, even if the selection key 302 is depressed during the copying operation, the simultaneous color copying mode is not executed.

When the selection key 302 is turned on, the copying apparatus K is changed over from the standard copying mode to the simultaneous color copying mode. In this state, the first and second levers 101 and 102 are slid along the slide slot 103 such that the regions A and C to be copied by the black toner and the region B to be copied by the red toner are designated as shown in FIG. 8. Meanwhile, the first and second levers 101 and 102 are adapted to function only when the simultaneous color copying mode is designated. Namely, even if the first and second levers 101 and 102 are operated when the simultaneous color copying mode is not designated, the first and second levers 101 and 102 do not function at all. In this state, when an original document S is placed on the original platform 90 and the print key 301 is turned on, the developing motor 24' is started such that the developing sleeve 12', the supply roller 14' and the screw 15' of the second developing device 5 are driven for rotation thereof in the directions of the arrows b, c and d, respectively. Thus, upon rotation of the supply roller 14' and the screw 15', the developer including the black toner, which is contained in the developing tank 11', is transported through the transport passages 16' and 17' while being mixed and agitated, so that a portion of the developer is supplied to the surface of the developing sleeve 12' by the supply roller 14' and thus, a magnetic brush is formed on the developing sleeve 12'.

Figure 17:
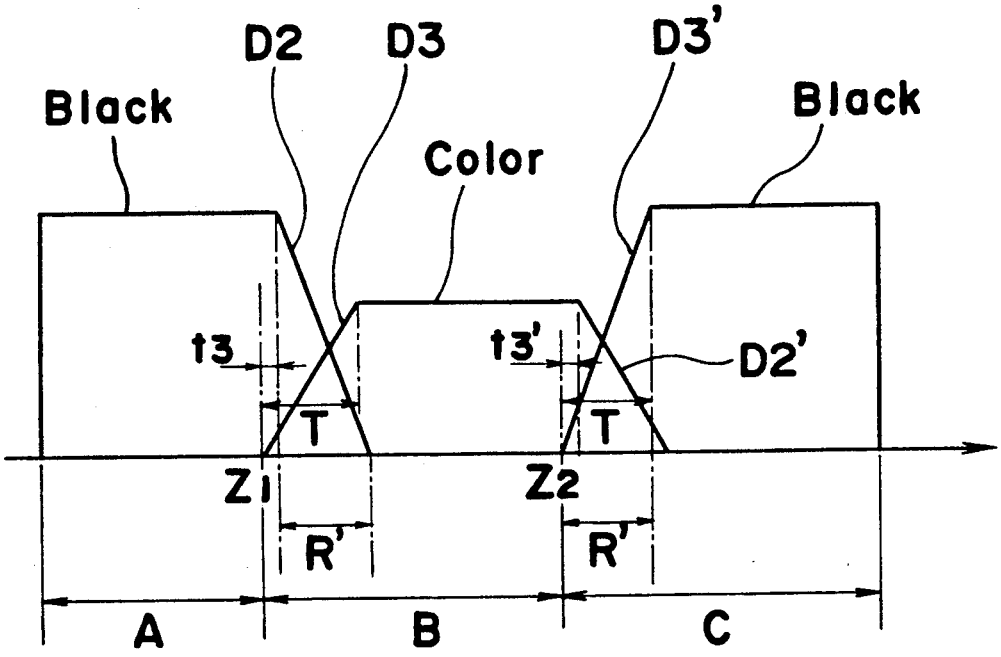

Upon rotation of the developing sleeve 12', this magnetic brush passes through the bristle height regulating gap Db such that bristle height of the magnetic brush is regulated by the bristle height regulating member 19'. Subsequently, the magnetic brush is sequentially fed to the developing region X' and thus, the electrostatic latent image on the photosensitive drum 1 is set to a developable state. Meanwhile, upon turning on of the print key 301, the scanner 40 starts displacement in the direction of the arrow B so as to irradiate light into the original document S placed on the original platform 90. Reflect light from the original document is projected onto the surface of the photosensitive drum 1 at the exposure point W so as to form an electrostatic latent image. This electrostatic latent image is initially developed by the second developing device 5. Meanwhile, since a front end portion of the electrostatic latent image and a latent image immediately after the front end portion of the electrostatic latent image are brought into contact with the magnetic brush at the developing region X' after the second developing device 5 has become fully operable, image density at these locations rises sharply as shown in FIG. 17.

Subsequently, when the magnet 101*a* of the first lever 101 is detected by the reed switch 110 of the scanner 40, the reed switch 110 outputs the detection signal to the second CPU 622. At this time, an electrostatic latent image corresponding to a boundary Z1 from the region A to be copied by the black toner to the region B to be copied by the red toner is disposed at the exposure point W on the photosensitive drum 1. For a time period t1 of 0.22 sec. during which the boundary Z1 travels from the position of the exposure point W to the position of the developing region X of the first developing device 4, only the second developing device 5 is operated.

When the boundary Z1 of the electrostatic latent image has reached the developing region X after the time period t1 from turning on of the reed switch 110, the motor 24 and the solenoid 33 of the first developing device 4 are turned on and off, respectively. Thus, the first developing device 4 is set to the state of FIGS. 4 and 5 in the same manner as the second developing device 5. Therefore, the developing sleeve 12, the supply roller 14 and the screw 15 are, respectively, rotated in the directions of the arrows b, c and d and a magnetic brush is formed on the surface of the developing sleeve 12 such that the electrostatic latent image on the photosensitive drum 1 is set to a developable state. Then, supply of the red toner to the electrostatic latent image corresponding to the region B is started by the first developing device 4. However, in the electrostatic latent image located at the developing region X at the time of start of the first developing device 4, time periods during which upstream and downstream portions of the electrostatic latent image with respect to the developing region X in the rotational direction of the photosensitive drum 1 are, respectively, brought into contact with the magnetic brush are different from each other. Therefore, as shown in FIG. 17, image density of the front end portion of the region B gradually shifts to a stable state via a development rise region D3.

Subsequently, after the time period t2 from start of the first developing motor 24, namely, upon lapse of a time period t of 0.2 sec. during which the boundary Z1 between the regions A and B travels from the developing region X to the developing region X' of the second developing device 5, the boundary Z1 reaches from the developing region X to the developing region X' of the second developing device 5. However, at this time, the motor 24' and the solenoid 33' of the second developing device 5 do not change their operational states. With a delay of a time period t3 this time point, the motor 24' is turned off and the solenoid 33' is turned on. Hence, the intermediate portion between the magnetic poles N1 and S1 confronts the photosensitive drum 1 and rotation of the developing sleeve 12', the supply roller 14' and the screw 15' is stopped, so that the developing operation of the region A by the black toner is terminated. At this time, since the electrostatic latent image on the photosensitive drum 1 is brought into contact with the developer over a predetermined width, image density gradually drops via a development fall region D2 as shown in FIG. 17 without dropping suddenly.

Meanwhile, as shown in FIG. 17, the time period t3 is properly set to a value within a development rise time T from start of the first developing device 4 to a state in which density of the toner image formed on the photosensitive drum 1 by the first developing device 4 becomes stable. Therefore, the black image and the red image are mixed with each other in the vicinity of the boundary Z1, thereby resulting in mixing of colors. However, a visual width R' of mixing of colors is restricted to the development fall region D2 of the black image having high density and neighboring portions of the boundary Z1 are reproduced completely.

When the scanner 40 is displaced further so as to reach the position of the second lever 102, i.e. a boundary Z2 between the regions B and C, the reed switch 110 is again turned on upon detection of the magnet 102*a* and outputs the detection signal to the second CPU 622. Meanwhile, at this time, the electrostatic latent image corresponding to the boundary Z2 is disposed at the exposure point W. After the time period t1 from turning on of the reed switch 110, the electrostatic latent image of the boundary Z2 reaches the developing region X. However, at this time, the motor 24 and the solenoid 33 of the first developing device 4 do not change their operational states. With a delay of a time period t3' from this time point, the motor 24 is turned off and the solenoid 33 is turned on, so that development of the region B by the red toner is terminated. Meanwhile, the time period t3' is properly set to a value within the development rise time T from start of the second developing device 5 to a state in which density of the toner image on the photosensitive drum 1 by the second developing device 5 becomes stable. The time period t3' is so set to be identical with the time period t3.

Thus, as shown in FIG. 17, a portion following the boundary Z2 is developed by the red toner during the time period t3'. Thereafter, at a development fall region D2', image density drops. Furthermore, after an interval of (t1+t2) from turning on of the reed switch 110, namely, when the boundary Z2 disposed at the developing region X has reached the developing region X' of the second developing device 5, the motor 24' and the solenoid 33' of the second developing device 5 are turned on and off, respectively such that development of the region C by the black toner is started. Also in this development of the region C, time periods during which electrostatic latent images disposed upstream and downstream of the developing region X', respectively at the time of start of the second developing device 5 are brought into contact with the developer are different from each other in the same manner as development of the front end portion of the region B by the first developing device 4, so that image density of the black toner of the second developing device gradually shifts to a stable state via a development rise region D3' without rising abruptly.

As a result, the black image and the red toner overlap each other in the vicinity of the boundary Z2 in the same manner as the vicinity of the boundary Z1 referred to above, thereby resulting in mixing of colors. However, the visual width R' of mixing of colors is restricted to the development rise region D3' of the black toner having high density and neighboring portions of the boundary Z2 are reproduced completely. The development operation of the second developing device 5 is continued until completion of scanning, whereby development of the region C is terminated. Meanwhile, since development of the electrostatic latent image disposed at the rear end portion of the region C is terminated when the second developing device 5 is held in a fully operable state, image density at this location decreases suddenly. By the above described operations, a two-color copy in which the developing color is changed over from black to red and further, from red to black is obtained during a time period from start of scanning to completion of scanning.

Figure 16A:
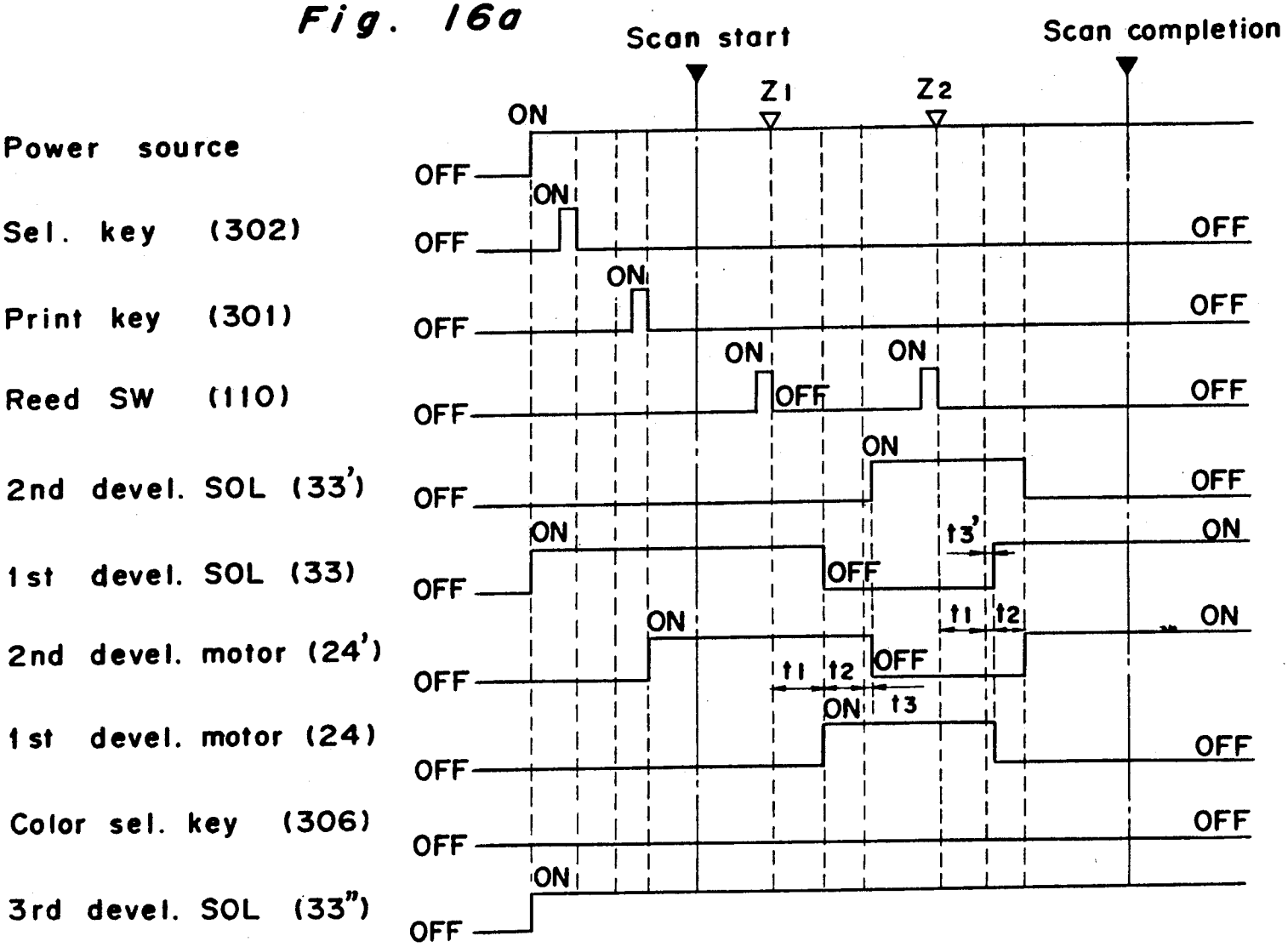
FIGS. 16*a*, 16*b*, 16*c* and 17 are timing charts showing copying in two colors simultaneously in the copying apparatus of FIG. 1.
Figure 16B:
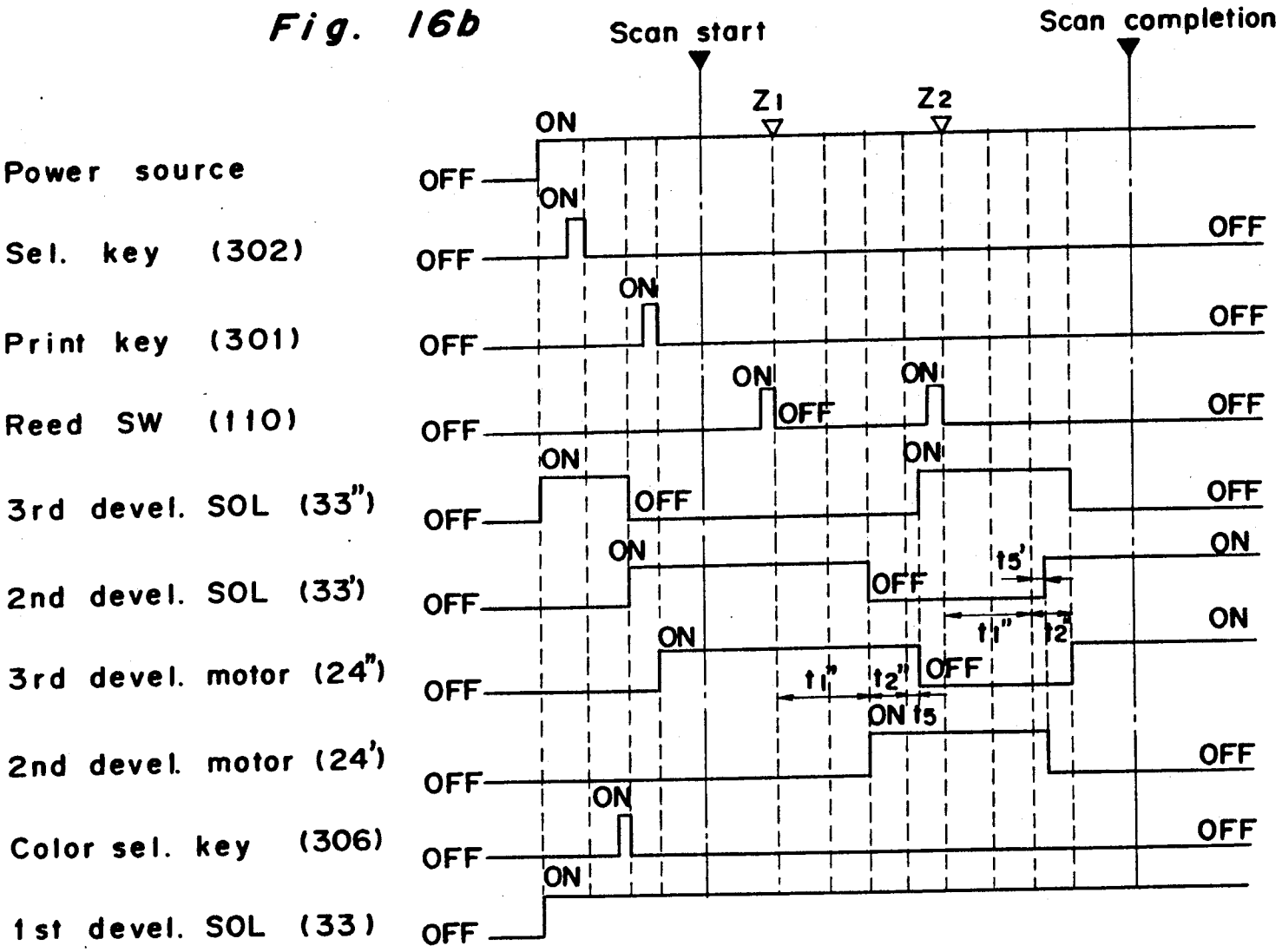

Meanwhile, FIG. 16*b* is a time chart in which the second and third developing devices 5 and 6 are selected by the color selection key 306 in the simultaneous color copying mode such that the simultaneous color copying mode is executed by the black toner and the blue toner. It is to be noted that reference numerals for components of the third developing device 6 are expressed by adding a double prime (") to those of the first developing device 4. When the second and third developing devices 5 and 6 have been selected by the color selection key 306 after turning on of the selection key 302 for selecting the simultaneous color copying mode, only the solenoid 33 of the first developing device 4 is held in the ON state during the copying operation so as to be set to an undevelopable state. In the same manner as in FIG. 12 except for this point, the second and third developing devices 5 and 6 are changed over for the copying regions such that a two-color copy in which the developing color is changed over from blue to black and further, from black to blue is obtained by a single copying operation.

Supposing that characters t1" denote a time period during which the photosensitive drum 1 travels from the exposure point W to the developing region X" and characters t2" denote a time period during which the photosensitive drum 1 travels from the developing region X' to the developing region X" and characters t5 and t5' denote time periods set properly based on the development rise time, respectively, the following relation is obtained.

$t1''=t1+t2$ $t2''=t2$ $t5=t5'$

Figure 2:
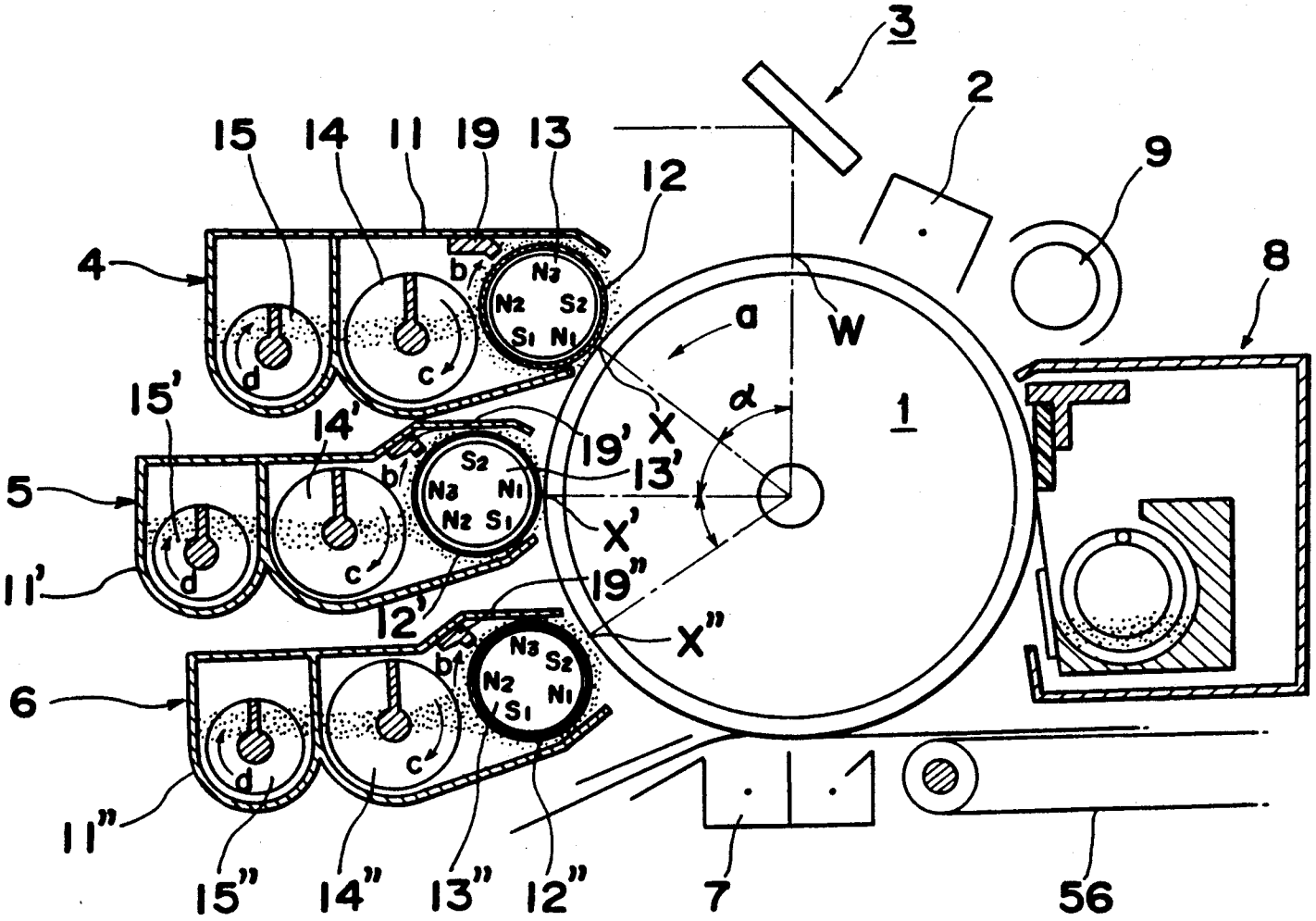
FIG. 2 is a sectional view of first, second and third developing devices employed in the copying apparatus of FIG. 1.
Figure 16C:
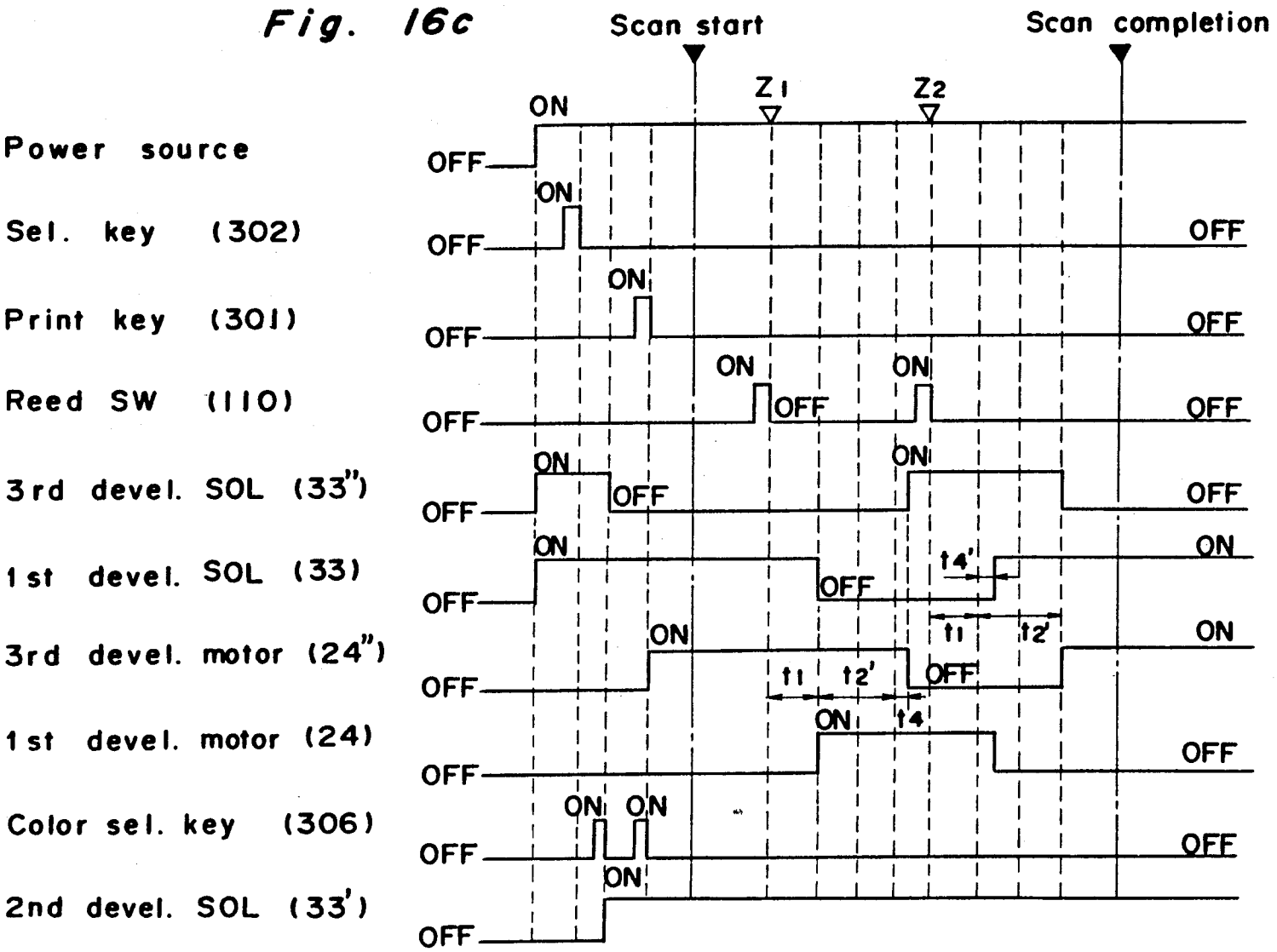

FIG. 16*c* is a time chart in which the simultaneous color copying mode is executed by selecting the first and third developing devices 4 and 6. Assuming that characters t1 denote a time period during which the photosensitive drum 1 travels from the exposure point W to the developing region X of the first developing device 4 and characters t2 denote a time period during which the photosensitive drum 1 travels an arc XX' is equal to an arc X'X" as shown in FIG. 2, the time period t2' assumes 2t2. Meanwhile, characters t4 and t4' denote time periods set properly based on the development rise time, respectively. In this case, a two-color copy in which the developing color is changed over from blue to red and further, from red to blue is obtained.

Meanwhile, in the above described embodiment. the developing color is changed over in a fixed order during one scanning operation. However, setting of the colors is not restricted to this example. Therefore, image editing pattern can be changed variously by increasing the number of the lever or changing order of start of development of the developing devices.

Meanwhile, in the above described embodiment, two developing devices to be used for simultaneous color copying are selected from among the three developing devices. However, it can also be so arranged that two developing devices to be used for simultaneous color copying are selected from among four or more developing devices.

Furthermore, in the above embodiment, at the time of nondevelopment, the developing motor 24 is stopped and the magnet roller 13 is rotated so as to retract the magnetic pole from the developing region X such that the magnetic pole is displaced to a portion of the magnet roller 13 confronting the bristle height regulating member 19. However, the magnetic pole is not necessarily required to be displaced at the time of development and nondevelopment as in the above embodiment. However, if this scheme of the above embodiment is employed, a possibility is low that the magnetic brush is brought into contact with the photosensitive drum 1, thereby resulting in prevention of mixing of colors.

Moreover, in the above described embodiment, the original platform 90 is fixed and the exposure lamp 41 is displaced for scanning. However, it can also be so arranged that the exposure lamp 41 is fixed and the original platform 90 is displaced for scanning.

As is clear from the foregoing, the copying apparatus of the present invention comprises the three or more developing devices containing the developers of different colors, respectively, the region designating means which divides in the scanning direction of the scanning system the support face for placing the original document thereon into a plurality of the copying regions so as to designate the copying regions, the control means which selectively changes over two of the developing devices for drive thereof at the changeover positions located at the boundaries of the copying regions designated by the region designating means such that copying in two colors simultaneously is performed by one copying operation and the selection means which, when the copying apparatus is set to the simultaneous color copying mode, arbitrarily selects from among the developing devices two developing devices to be driven in the simultaneous color copying mode. Therefore, in accordance with the present invention, combinations of two developing devices, which are required to be selected at the time of execution of the simultaneous color copying mode, can be easily selected from among the three or more developing devices.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as being included therein.

What is claimed is:

1. An electrophotographic copying apparatus comprising:

a document support member for holding a document thereon;

an image forming means which scans an image of an original document so as to form an electrostatic latent image of the original document on a photosensitive member;

developing means for developing the elastrostatic latent image formed on said photosensitive member by said image forming means;

said developing means including three or more developing devices containing developers of different colors, respectively;

selecting means for arbitrarily selecting two of said developing devices;

region designating means which is arranged adjacent to said document support member to move in a scanning direction of said image forming means and designates, for said two developing devices selected by said selecting means, positions specifying regions of the electrostatic latent image to be developed, respectively;

signal generating means, responsive to arrival of said image forming means at a position designated by said region designating means, for generating a signal for changing over operation from one to another of said selected two developing devices relative to one scanning operation of said image forming means; and actuating means for sequentially actuating, in response to the signal generated by said signal generating means, said two developing devices during one scanning operation of said image forming means so as to form a two-color image.

2. An electrophotographic copying apparatus as claimed in claim 1, wherein said region designating means includes a plurality of levers, a plurality of magnets attached to said levers, respectively and a reed switch for detecting said magnets.

3. An electrophotographic copying apparatus as claimed in claim 1, wherein said actuating means includes a main central processing unit, an auxiliary central processing unit for controlling said image forming means and a random access memory.

4. An electrophotographic copying apparatus comprising:

a document support member for holding a document thereon;

an image forming means which scans an image of an original document so as to form an electrostatic latent image of the original document on a photosensitive member;

developing means for developing the electrostatic latent image formed on said photosensitive member by said image forming means;

said developing means including three or more developing devices containing developers of different colors, respectively;

copying mode selecting means for selecting first and second copying modes of said copying apparatus;

developing color selecting means for selecting one or more of said developing devices to be driven;

wherein when the first copying mode is selected by said copying mode selecting means, said developing color selecting means is capable of selecting an arbitrary one of said developing devices;

wherein when the second copying mode is selected by said copying mode selecting means, said developing color selecting means is capable of arbitrarily selecting two of said developing devices;

region designating means which is arranged adjacent to said document support member to move in a scanning direction of said image forming means and designates, for said two developing devices selected in the second copying mode by said developing color selecting means, positions specifying regions of the electrostatic latent image to be developed, respectively;

signal generating means for generating a signal for changing over operation from one to another of said selected two developing devices relative to one scanning operation of said image forming means in response to arrival of said image forming means at a position designated by the region designating means; and actuating means which, in the first copying mode, actuates said developing device selected by said developing color selecting means so as to form a single color image and, in the second copying mode, sequentially actuates, in response to the signal from said signal generating means, said two developing devices selected by said developing color selecting means so as to form a two-color image during one scanning operation of said image forming means.

5. An electrophotographic copying apparatus as claimed in claim 4, wherein said region designating means includes a plurality of levers, a plurality of magnets attached to said levers, respectively and a reed switch for detecting said magnets.

6. An electrophotographic copying apparatus as claimed in claim 4, wherein said actuating means includes a main central processing unit, an auxiliary central processing unit for controlling said image forming means and a random access memory.

7. An electrophotographic copying apparatus comprising:

an image forming means which scans an image of an original document positioned on an original document platform so as to form an electrostatic latent image of the original document on a photosensitive member;

at least three developing devices which are sequentially arranged along said photosensitive member and contained developers of different colors, respectively;

selecting means for selecting plural ones of said developing devices to be driven;

designating means which is arranged adjacent to said original platform to move in a scanning direction of said image forming means and divides an area of the image of the original document into a plurality of regions in the scanning direction of said image forming means so as to designate positions specifying the regions;

circuit means for generating a signal for changing over operation from one to another of said plural ones of said selected developing devices relative to one scanning operation of said image forming means in response to arrival of said image forming means at a position designated by the region designating means; and actuating means which, during one scanning operation of said image forming means, sequentially actuates, in response to the signal generated by said circuit means, said plural developing devices selected by said selecting means so as to form a multicolor image.

8. An electrophotographic copying apparatus as claimed in claim 7, wherein said designating means includes a plurality of levers, a plurality of magnets attached to said levers, respectively and a reed switch for detecting said magnets.

9. An electrophotographic copying apparatus as claimed in claim 7, wherein said actuating means includes a main central processing unit, an auxiliary central processing unit for controlling said image forming means and a random access memory.

* * * * *